United States Patent [19]

Drach

[11] Patent Number: 4,480,343

[45] Date of Patent: Nov. 6, 1984

[54] COMBINATION DRAIN AND CUTTING BOARD

[76] Inventor: Edward Drach, 4390 Richardson Ave., Bronx, N.Y. 10466

[21] Appl. No.: 481,915

[22] Filed: Apr. 4, 1983

[51] Int. Cl.[3] ..... A47L 19/02; A47L 19/04

[52] U.S. Cl. ..... 4/656; 4/637; 4/638; 108/16; 108/13; 211/41; 211/126; 211/2

[58] Field of Search ..... 4/656, 637, 661, 631, 4/654, 650, 658, 520; 211/41, 126, 2; 108/14, 24, 11, 16, 13

[56] References Cited

U.S. PATENT DOCUMENTS

| | | | |
|---|---|---|---|
| D. 244,827 | 6/1977 | Nevai | D7/5 |
| 312,999 | 2/1885 | Junod | 108/24 X |
| 395,393 | 1/1889 | Holzmark | 108/24 X |
| 1,224,838 | 5/1917 | Blissman et al. | 4/656 X |
| 1,349,771 | 8/1920 | Kline | 4/656 |
| 1,628,746 | 5/1927 | Russel | 4/656 |
| 1,643,906 | 9/1927 | Russel | 4/656 |
| 1,728,502 | 9/1929 | McGregor | 4/656 |
| 2,954,875 | 10/1960 | Becker | 211/41 |
| 2,965,424 | 12/1960 | Baney | 108/14 |
| 3,417,875 | 12/1968 | Barkar | 211/126 |
| 4,169,638 | 10/1979 | Cirasuolo et al. | 211/41 |
| 4,372,448 | 2/1983 | Drach | 211/41 |

*Primary Examiner*—Henry K. Artis
*Attorney, Agent, or Firm*—James & Franklin

[57] ABSTRACT

The board consists of a planar member having first and second surfaces. The first surface, upon which a dish rack may be placed, is supported by legs at an incline and is provided with upwardly extending protrusions designed to engage the dish rack to prevent same from slipping along the first surface. The effective length of the support legs can be altered to change the incline. Other protrusions extending from the first surface cooperate with upstanding walls to retain utensils. The second surface functions as a cutting board and is supported at an incline, in part, by the dish rack engaging protrusions. Upstanding parallel ribs form a horizontal platform above one of the surfaces.

17 Claims, 9 Drawing Figures

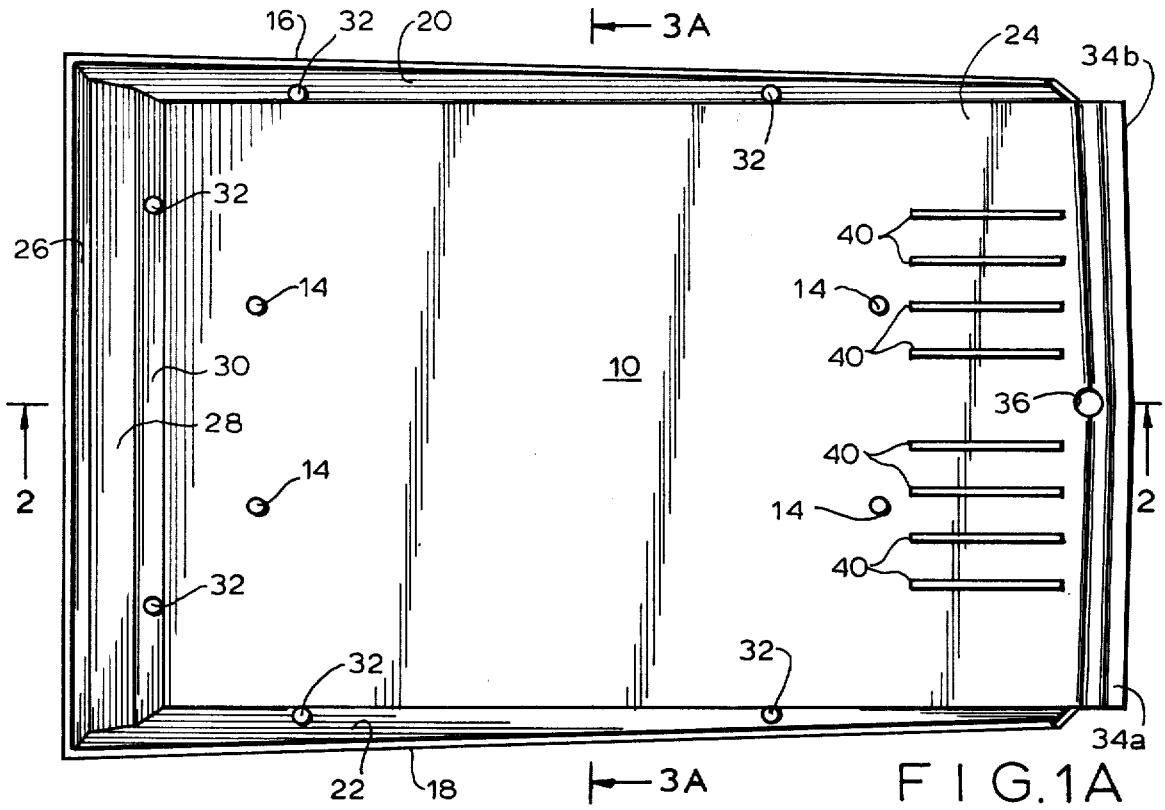
FIG.1A
FIG.1B
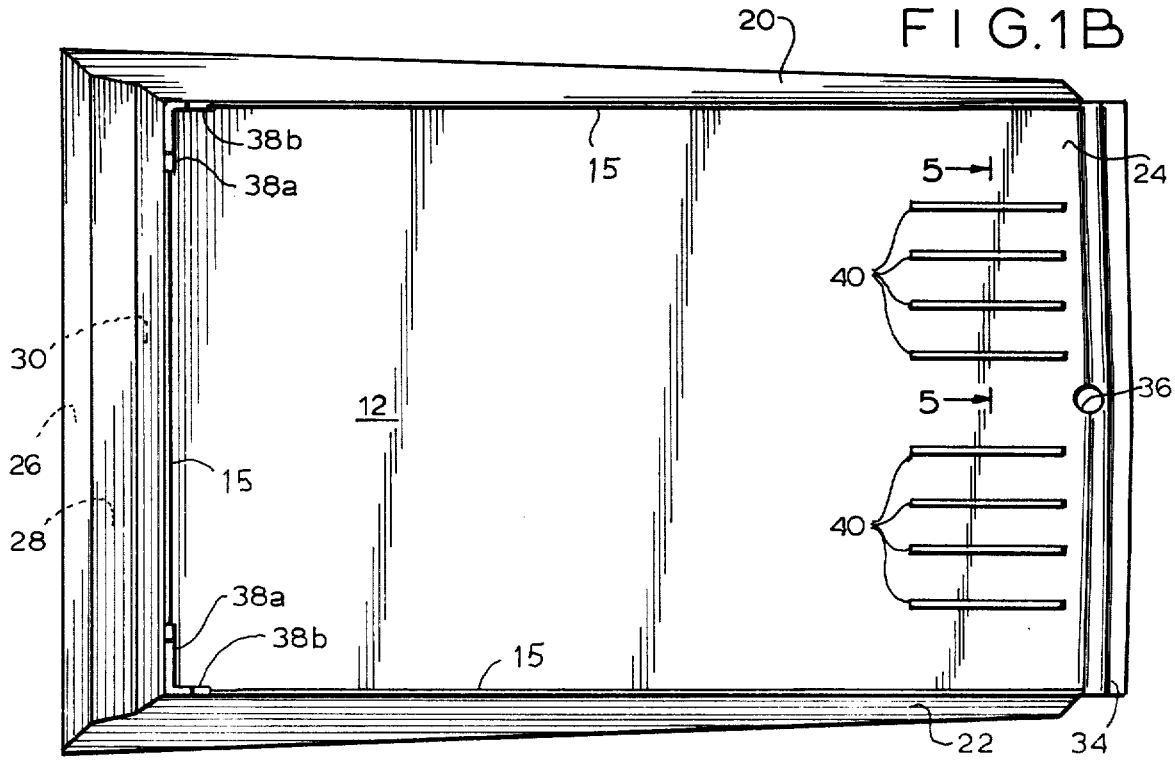

COMBINATION DRAIN AND CUTTING BOARD

The present invention relates to apparatus functioning as drain board and as cutting surface primarily designed for kitchen usage and, more particularly, to a combination drain and cutting board adapted for use with a dish rack or the like.

In the past, drain boards and cutting boards have been separate units. Known cutting boards are normally comprised of a rectangular piece of wood or plastic having a horizontal cutting surface. The surface must be of relatively high strength, such that it can withstand the downward forces of a cutting utensil. Thus, such cutting boards are designed to lay flat on a counter top or the like and normally cannot be inclined to provide run-off in a particular direction for disposal or collection of juices or the like.

Drain boards, on the other hand, are normally made of flexible plastic or rubber-like material with a drain surface which is mounted at an incline such that when the drain board is situated on a counter top adjacent a sink, the run-off will be directed into the sink for disposal. Some drain boards are designed for use in conjunction with a dish rack such that the dish rack may be placed on the inclined drainage surface. However, in such instances, problems arise with respect to slippage of the dish rack along the inclined drainage surface. Specifically, because the drainage surface is wet and, thus, slippery, if it is maintained at a substantial incline, the dish rack may tend to slip along the drainage surface and ultimately fall into the sink. Clearly, this is a result to be avoided because slippage of the dish rack into the sink will cause breakage of the dishes and/or utensils situated thereon.

Generally, drain boards which are adapted for use with dish racks do not themselves contain means for retaining utensils thereon. Such utensil retaining means are often useful for the temporary storage of utensils, such as large knives or the like and whether the drain board is being used with the dish rack or not. Even though it is desirable to design the drain board with utensil retaining means, this is normally not possible because same interferes with the mounting of the dish rack on the drainage surface. Moreover, such utensil retaining means tend to be somewhat complex in construction and, consequently, add a substantial portion to the cost of the drain board.

Another problem with conventional drain boards relates to the fact that the incline of the drainage surface, with respect to the surface upon which the drain board rests, is fixed. However, certain drainage operations can be performed more efficiently at steeper inclines. It would therefore be advantageous if the incline of the drainage surface could be made variable. However, the steeper the incline, the more likely is the dish rack mounted on the drainage surface to slip.

Most drain boards are provided for use on a counter top adjacent to a sink and many are provided with a downwardly rounded lip adapted to overhang the rim of the sink and extend a short distance into the interior thereof. However, lips of this type effectively prevent the unit from being turned upside down such that the surface opposite the drain surface can be utilized. This is because the lip prevents drainage from the opposite surface into the sink.

It is, therefore, a prime object of the present invention to provide a combination drain and cutting board which can be used in conjunction with a dish rack or the like.

It is another object of the present invention to provide a combination drain and cutting board which includes means on the drainage surface for engaging a dish rack so as to prevent relative movement between the dish rack and the drainage surface.

It is another object of the present invention to provide a combination drain and cutting board wherein the dish rack engaging means extending from the drainage surface can be utilized as a means for supporting the cutting surface.

It is another object of the present invention to provide a combination drain and cutting board which includes simple utensil retaining means associated with the drainage surface, which does not interfere with the mounting of a dish rack thereon.

It is another object of the present invention to provide a combination drain and cutting board with a lip constructed to permit liquid drainage from both the drainage surface and the cutting surface.

It is another object of the present invention to provide a combination drain and cutting board including a generally horizontal drainage platform extending from one of the surfaces.

It is another object of the present invention to provide a combination drain and cutting board which can be situated adjacent a sink when the drain surface is in use and mounted over a sink when the cutting board is in use.

In accordance with the present invention, a combined drain and cutting board is provided for use with a dish rack having a laterally extending member, or the like. The board comprises a substantially planar member having first and second surfaces. Means are provided for supporting the first surface at an incline. Means, mounted on and extending from the first surface, are provided for engaging a laterally extending member of a dish rack situated thereon such that movement of the dish rack relative to the first surface in the direction of the incline is substantially prevented.

Means are provided for supporting the second surface at an incline. Preferably, the second surface support means comprises the dish rack engaging means. Thus, the dish rack engaging means serve a dual function, depending upon whether the board is being used as a drain board or as a cutting board.

The board further comprises a wall extending from the first surface and a protrusion extending from the first surface in the same general direction as the wall, but spaced therefrom. The wall and the protrusion form a utensil retaining means which is of simple construction and does not obstruct the area on the first surface upon which the dish rack rests.

The wall has an additional function. The wall, along with the dish rack engaging means, comprise the means for supporting the second surface at an incline.

The planar member includes a lip member extending from one end thereof. The lip member comprises a first part situated in a plane generally perpendicular to the first surface, and a second part extending from the first part in a plane generally parallel to the first surface. The second part is preferably divided into sections which are inclined towards each other. The lip member further comprises a drainage port. Preferably, the drainage port is located in alignment with a portion of the lip located between the sections of the second part.

One of the surfaces of the board includes a set of substantially parallel spaced upstanding ribs. Each of the ribs has a top edge. The top edges of the ribs are substantially coplanar, thus forming a platform.

The plane of the top edges is preferably inclined with respect to the surface upon which the ribs are mounted. The incline of the plane of the top surfaces is substantially opposite to the incline of the surface upon which the ribs are mounted. Consequently, the platform formed by the top surfaces will be in a substantially horizontal plane when the board is situated on a counter top or the like.

The support means for the first surface are provided with means for adjusting the effective length thereof such that the incline of the first surface can be varied. The support means comprises a first part extending from the second surface and having an end and a second part adapted to be situated substantially co-linearly with the end of the first part. Means are provided for mounting the second part on the first part.

The first part has a substantially planar body with opposite surfaces. The opposite surfaces each have a recess. The mounting means preferably comprises a resilient bifuricated part adapted to receive the first part and at least partially extend into the recesses.

To these and to such other objects which may hereinafter appear, the present invention relates to a combination drain and cutting board, as described in the following specification and recited in the annexed claims, taken together with the accompanying drawings, wherein like numerals refer to like parts, and in which:

FIGS. 1A and 1B are, respectively, top and bottom elevational views of the combined drain and cutting board of the present invention;

Figure 2:
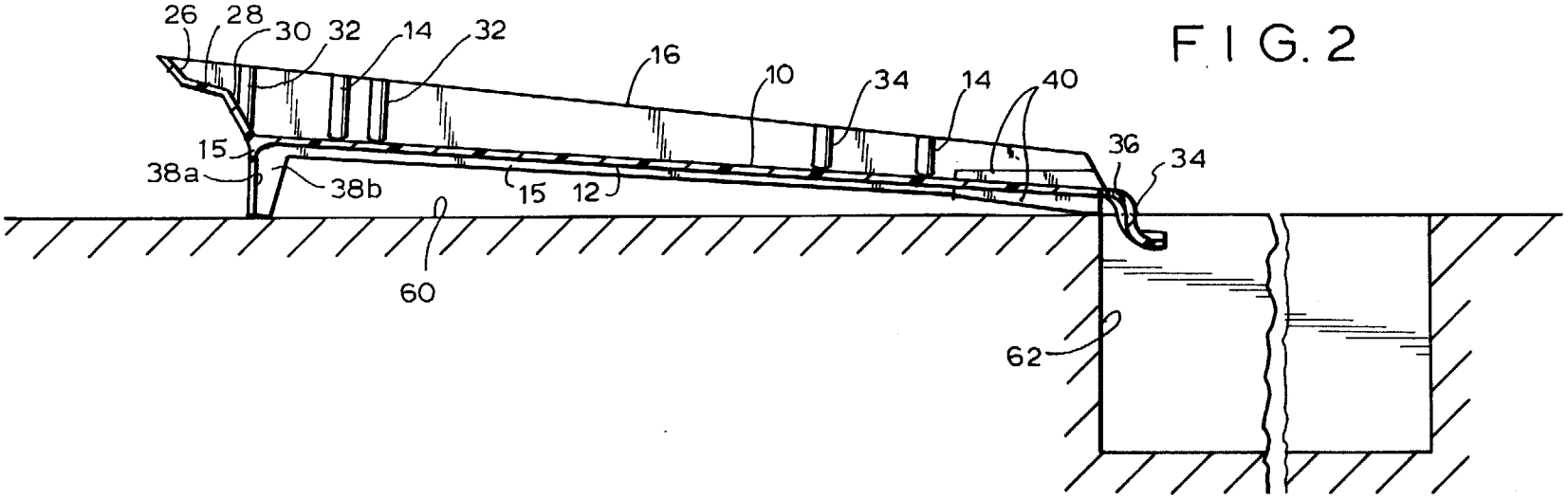
FIG. 2 is a side cross-sectional view of the combination drain and cutting board of the present invention, showing same utilized as a drain board adjacent to a sink.

The combination drain and cutting board of the present invention, as illustrated in FIGS. 1A and 1B, consists of a substantially planar member having a first or drain surface 10, and a second or cutting surface 12 situated on opposite sides of the planar member. Extending upwardly from the interior of drain surface 10 are four spaced substantially cylindrical protrusions 14. Protrusions 14 have a dual function. When the board is used as a drain board, in conjunction with a dish rack, the dish rack is placed on surface 10 which is supported at an inclined angle with respect to a counter top or the like, adjacent a sink. Protrusions 14 serve to engage laterally extending members on the bottom surface of the dish rack so as to prevent movement of the dish rack relative to surface 10, in the direction of the incline.

Protrusions 14 also act to support the interior of surface 12 when the board of the present invention is utilized as a cutting board and placed on a planar surface such as a counter top. The top surfaces of projections 14 are substantially coplanar with the top edges 16 and 18 of upstanding and inwardly inclined side members 20 and 22 which extend from surface 10. Since the top edges 16 and 18 of sides 20 and 22 are also inclined towards the front 24 of the board, sides 20 and 22, in conjunction with projections 14, function to support surface 12 at an incline angle with respect to a counter top or the like. The sides and rear edges of surface 12 are provided with a rim 15, so as to prevent run-off from surface 12 in any direction other than the front 24 of the board.

A rear wall 26, also inclined towards surface 10, is provided between sides 20 and 22. Between rear wall 26 and surface 10 is a shelf-like structure formed of a surface 28, downwardly inclined from the horizontal, and a surface 30 inwardly inclined from the vertical which are situated between rear wall 26 and surface 10.

Distributed around the periphery of surface 10 are a plurality of upstanding cylindrical projections 32 extending from sides 20 and 22 and surface 30. Projections 32 cooperate with the adjacent upstanding inclined surfaces 20, 22, and 23 so as to form utensil receiving recesses for the temporary storage of a knife or the like. Projections 32 are located so as not to interfere with the mounting of a dish rack thereon.

Figure 3A:
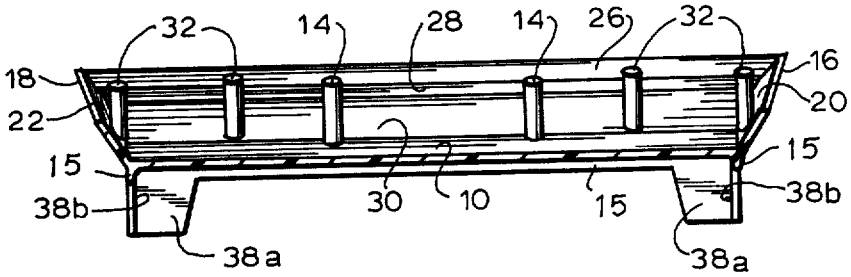
FIG. 3A is a front cross-sectional view of the combination drain and cutting board of the present invention taken along line 3A of FIG. 1A.
Figure 3B:
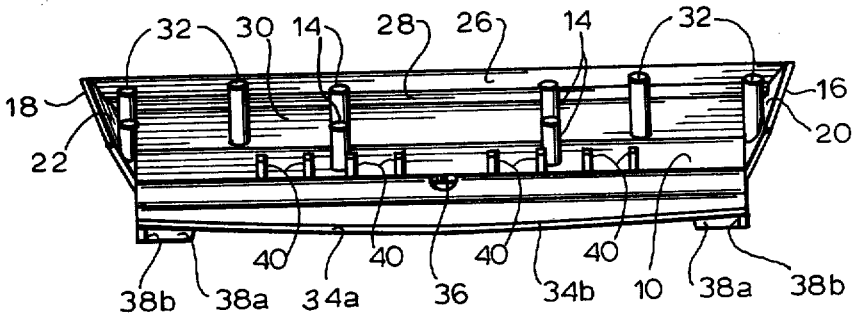
FIG. 3B is a front elevational view of the combination drain and cutting board of the present invention.

Located at the forward end 24 of the board is a curved lip 34 which extends downwardly and outwardly from the forward edge of surface 10. Lip 34 is divided into two parts **34*a* and 34*b* along the center line of surface 10. Lip portions 34*a* and 34*b* are slightly inclined with respect to the center line of surface 10, as best seen in FIG. 3B, such that the center portion of lip 34** extends forward slightly more than the peripheries of the lip.

Located at the boundary between lip 34 and surface 10, along the center line of surface 10, is a drainage port 36. As will be appreciated by comparison of FIGS. 1A and 1B, port 36 is situated partially in surface 10 and partially in lip 34. As explained below, port 36 functions primarily to permit drainage from surface 12.

As can be best seen from FIG. 1B, a pair of legs 38 extend from the respective rear corners of surface 12 and function to support surface 10 at an incline. Legs 38 each include a rear element **38*a* and a side element 38*b*, which meet at substantially right angles. Each of the elements 38*a* and 38*b*** has a downwardly and inwardly inclined outer edge.

Extending outwardly from the forward portion 24 of surfaces 10 and 12, immediately behind lip 34, are a plurality of spaced parallelly extending ribs 40, each having a top edge. The top edges of ribs 40 are situated in substantially the same plane. The top edges of ribs 40 are inclined with respect to the surface from which they extend, in a direction which is substantially opposite to the incline of the surface from which they extend, such that when the board is supported on a horizontal surface, such as a counter top or the like, the coplanar top surfaces of ribs 40 form a drainage platform which is substantially horizontal.

Figure 7:
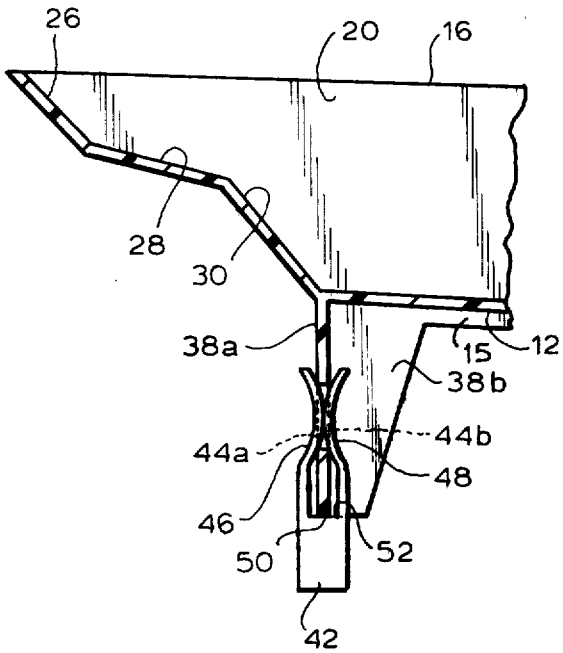
FIG. 7 is a side cross-sectional view of the support leg of the combination drain and cutting board of the present invention.
Figure 6:
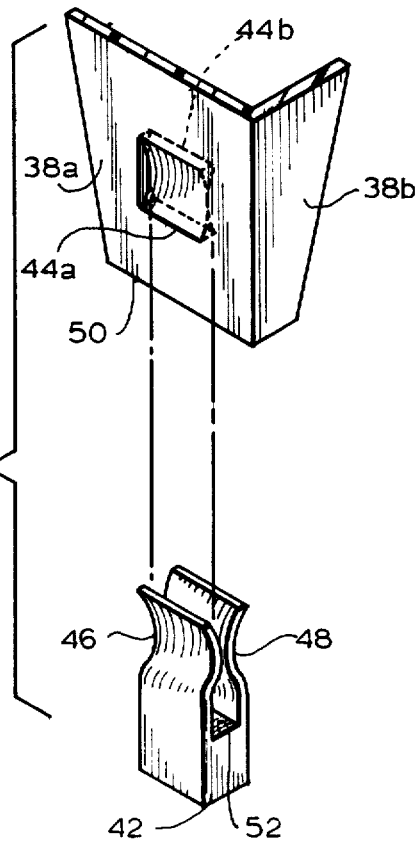
FIG. 6 is an exploded isometric view of the support leg of the combination drain and cutting board of the present invention.
Figure 5:
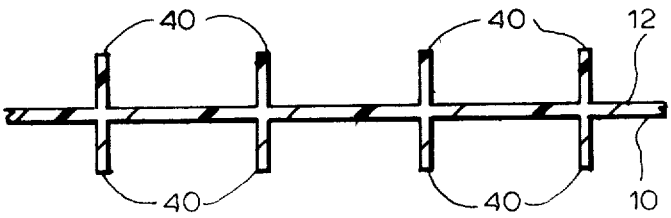
FIG. 5 is a cross-sectional view of a portion of the combination drain and cutting board of the present invention as seen along line 5—5 of FIG. 1B.

As best seen in FIGS. 6 and 7, the effective length of support legs 38 can be altered through the use of bifuricated parts 42. Elements 38*a* of each of the support legs 38 is provided with aligned recesses 44*a* and 44*b* on the opposite surfaces thereof. Part 42 includes a pair of upwardly extending spaced resilient members 46 and 48 which include inwardly curved or concave mid-sections. The outwardly curved top portions of parts 46 and 48 permit the parts to be cammed apart by the bottom portion of leg 38 and, thereafter, once the inwardly curved concave portion of parts 46 and 48 align with recesses 44*a* and 44*b*, to be received within the recesses. Once received within the recesses, the bottom edge 50 of element 38*a* rests on edge 52 of element 42. Edge 52 of element 42 forms the bottom of a recess partially defined by parts 46 and 48. Thus, the use of part 42 in conjunction with support leg 38 alters the effective length of the leg so as to support surface 10 at a greater incline for more rapid and effective drainage.

When used as a drain board, that is, with surface 10 facing upwardly, the present invention can rest on a counter top 60 adjacent the rim of a sink 62, as shown in FIG. 2. In this instance, support legs 38 rest on counter top 60 as do the coplanar edges of ribs 40 so as to support surface 10 at an incline with respect to the sink. Lip 34 extends over the rim of the sink partially into the interior thereof so as to guide run-off to the interior of the sink. A dish rack, of any conventional design, may be situated on surface 10 such that laterally extending members thereof abut one or the other or both of the pairs of dish rack engaging projections 14. Knives or kitchen utensils may be temporarily stored between projections 32 and the adjacent inclined upstanding walls.

Figure 4:
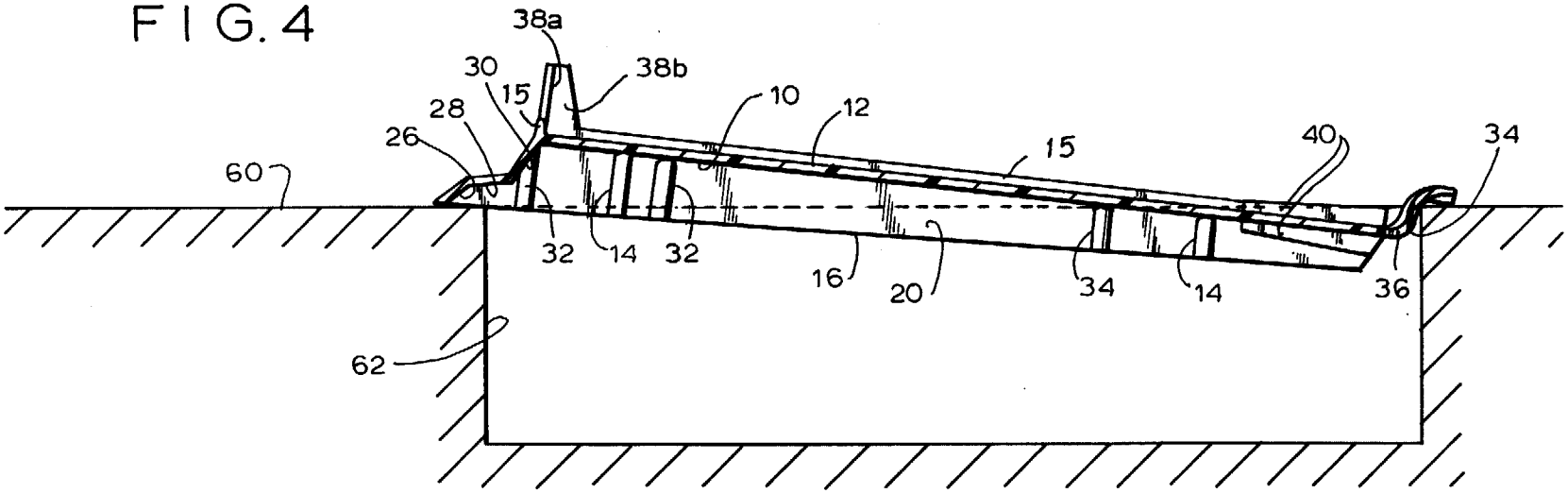
FIG. 4 is a side cross-sectional view of the combination drain and cutting board of the present invention showing same in use as a cutting board mounted over the interior of a sink.

When used as a cutting board over the interior of a sink, as illustrated in FIG. 4, the rear portion of the board rests on one section of the sink rim, whereas the lower portion of lip 34 rests on the opposite portion of sink rim. In this manner, surface 12 is supported at an incline, towards lip 34. Run-off from surface 12 will drain into the interior of the sink through port 36. It should be noted that any run-off reaching the portion of lip 34 adjacent surface 12 is directed towards the center of surface 12 and, thus, port 36, by the slight incline of portions 34*a* and 34*b* towards the center line. It should also be noted that when mounting in this manner, the platform formed by the upper surfaces of ribs 40 is only slightly inclined with respect to the horizontal and, consequently, can be used for temporary placement of a knife or the like, without interrupting run-off from surface 12.

It should be appreciated that the board of the present invention can be utilized as a cutting board, with surface 12 facing upward, but mounted on a counter top instead over the interior of the sink, much the same as shown in FIG. 2. In this configuration, surface 12 will be situated at an incline with respect to the horizontal by edges 16 and 18 of sides 20 and 22, respectively, and by dish rack engaging projections 14, will support the interior of surface 12 so as to prevent any buckling or the like during the cutting operation. When used in this manner, the platform formed by the upper coplanar edges of ribs 40 will be substantially horizontal, that is, parallel with the counter top. Normally, when used in this fashion, lip 34 will overhang the sink rim such that run-off to port 36 will be directed into the sink. Alternatively, a collection vessel may be inserted below port 36 so as to retain the run-off for future usage, if desired.

It will now be appreciated that the present invention relates to a combination drain and cutting board in which the inclined drain surface is provided with dish rack engaging projections to prevent the slippage of a dish rack with respect thereto. These projections perform the second function, when the board is used as a cutting board, of supporting the interior of the cutting surface to prevent the buckling thereof during the cutting operation. The drainage surface also has additional protrusions which cooperate with the side and rear walls thereof to form utensil retaining means for the temporary storage of a knife or the like.

The drainage surface is supported by a pair of legs which retains same at an incline with respect to the horizontal. The support legs can be utilized in conjunction with bifuricated members which alter the effective length thereof such that the drain surface is held at a greater incline. The cutting surface is provided with a substantially horizontal platform upon which a knife or similar utensil may be temporarily placed without obstructing run-off. The board may be mounted adjacent to the rim of a sink or over the interior of the sink, as desired.

While only a single preferred embodiment of the present invention has been disclosed herein for purposes of illustration, it is obvious that many variations and modifications could be made thereto. It is intended to cover all of these variations and modifications which fall within the scope of the present invention as defined by the following claims:

I claim:

1. A combination drain and cutting board for use with a dish rack having a laterally extending member or the like comprising a substantially planar member having first and second opposing surfaces adapted to be used alternately in first and second orientations to provide drain and cutting surface functions, respectively, said first surface being adapted to receive a dish rack thereon when said member is in said first orientation, means for supporting said member with said first surface at an incline, means, mounted on and extending from said first surface, for engaging the laterally extending member of the dish rack such that movement of the dish rack relative to the first surface is substantially prevented, said second surface having a substantially unobstructed portion adapted to function as a cutting surface when said member is in said second orientation.

2. The board of claim 1, wherein said engaging means comprises a substantially cylindrical projection.

3. The board of claim 1, further comprising means for supporting said second surface at an incline, said second surface support means comprising said dish rack engaging means.

4. The board of claim 1, further comprising a side extending from said first surface, said side having an edge inclined with respect to said first surface.

5. The board of claim 3, further comprising a side extending from said first surface, said side having an edge inclined with respect to said first surface.

6. The board of claim 5, wherein said edge and the top of said engaging means are substantially coplanar.

7. The board of claim 5, wherein said side comprises said second surface support means.

8. The board of claim 1, further comprising a wall extending from said first surface and a protrusion extending from said first surface in the same general direction as said wall, but having a portion spaced therefrom, so as to define utensil retaining means.

9. The board of claim 1, wherein said planar member comprises a lip member extending from one end thereof, said lip member comprising a first part situated in a plane generally perpendicular to said first surface and a second part extending from said first part in a plane generally parallel to said first surface.

10. The board of claim 9, wherein said second part is divided into sections inclined towards each other.

11. The board of claim 9, further comprising a lip and a drain port situated partially in said surfaces and partially in said lip.

12. The board of claim 1, wherein one of said surfaces comprises a set of substantially parallel, spaced upstanding ribs, each having a top surface and wherein said top surfaces are substantially coplanar.

13. The board of claim 12, wherein said plane of said top surfaces is inclined with respect to said one of said surfaces.

14. The board of claim 13, wherein the incline of said plane of said top surfaces is substantially opposite to the incline of said one surface.

15. The board of claim 1, further comprising means for adjusting the effective length of said first surface support means.

16. The board of claim 1, wherein said first surface support means comprises a first part extending from said second surface and having an end and a second part adapted to be situated substantially colinearly with said first part and adjacent said end, and means for mounting said second part on said first part.

17. The board of claim 16, wherein said first part has a substantially planar body with opposite surfaces and wherein said opposite surfaces each have a recess and wherein said mounting means comprises a resilient bifuricated part adapted to receive said first part and at least partially extend into said recesses.

* * * * *